US009340917B2

(12) United States Patent
Carrillo

(10) Patent No.: US 9,340,917 B2
(45) Date of Patent: May 17, 2016

(54) SEAL ASSEMBLY FOR A LAUNDRY TREATING APPLIANCE

(75) Inventor: Raul Hernandez Carrillo, Monterrey (MX)

(73) Assignee: Whirlpool Corporation, Benton Harbor, MI (US)

( * ) Notice: Subject to any disclaimer, the term of this patent is extended or adjusted under 35 U.S.C. 154(b) by 641 days.

(21) Appl. No.: 13/326,384

(22) Filed: Dec. 15, 2011

(65) Prior Publication Data

US 2013/0152641 A1 Jun. 20, 2013

(51) Int. Cl.
*D06F 37/26* (2006.01)
*D06F 39/14* (2006.01)

(52) U.S. Cl.
CPC ..... *D06F 37/266* (2013.01); *D06F 39/14* (2013.01); *Y10T 29/49826* (2015.01)

(58) Field of Classification Search
CPC ..... D06F 37/266; D06F 39/14
USPC ..... 34/242; 68/5 E, 12.26
See application file for complete search history.

(56) References Cited

U.S. PATENT DOCUMENTS

| | | | | |
|---|---|---|---|---|
| 6,442,981 | B1 | 9/2002 | Augustsson | |
| 6,862,903 | B2 | 3/2005 | Nitschmann et al. | |
| 6,910,286 | B2 | 6/2005 | Hwang | |
| 6,931,761 | B2 | 8/2005 | Hwang | |
| 7,299,666 | B2 | 11/2007 | Geyer et al. | |
| 7,398,662 | B2 | 7/2008 | Kim et al. | |
| 7,581,412 | B2 | 9/2009 | Kim et al. | |
| 2003/0110817 | A1* | 6/2003 | Nitschmann et al. | 68/139 |
| 2004/0163426 | A1* | 8/2004 | Kim et al. | 68/23 A |
| 2007/0130790 | A1 | 6/2007 | Jung | |
| 2009/0126417 | A1* | 5/2009 | Ripley | D06F 58/04 68/196 |

FOREIGN PATENT DOCUMENTS

| | | | |
|---|---|---|---|
| DE | 10031170 | A1 | 1/2002 |
| DE | 10031172 | A1 | 1/2002 |
| EP | 1595992 | B1 | 7/2008 |

OTHER PUBLICATIONS

German Search Report for Counterpart DE102012109786, Jun. 11, 2013.

* cited by examiner

*Primary Examiner* — Joseph L Perrin
*Assistant Examiner* — Levon J Shahinian

(57) ABSTRACT

A seal assembly and method for sealing a door and a tub in a laundry treating appliance.

16 Claims, 6 Drawing Sheets

SEAL ASSEMBLY FOR A LAUNDRY TREATING APPLIANCE

BACKGROUND

Laundry treating appliances, such as clothes washers, include a rotatable drum within a tub. The tub and drum are provided with aligned openings to allow access to the interior treating chamber of the drum, which is selectively closed by a door. The appliance may be provided with a bellows which provides a seal between the tub opening and door when the door is closed, preventing the leakage of liquid from within the tub and drum. The bellows is typically a large piece of rubber that may be difficult to clean and may also wear over time. In addition, the large size of the bellows may result in undesired contact between the bellows and laundry items within the treating chamber.

BRIEF SUMMARY

According to an embodiment of the invention, a laundry treating appliance configured to execute a cycle of operation for the treating of laundry comprises a tub at least partially defining an interior and having a tub opening providing access to the tub interior and a drum at least partially defining a treating chamber and having a drum opening providing access to the treating chamber. The laundry treating appliance may also include a door selectively moveable to close the tub opening and having a flat panel, with a rear planar side of the door facing the tub and lying exteriorly of the tub opening when the door closes the tub opening and a seal assembly provided on at least one of the rear planar side and the tub to seal the rear planar side relative to the tub.

DETAILED DESCRIPTION

Figure 1:
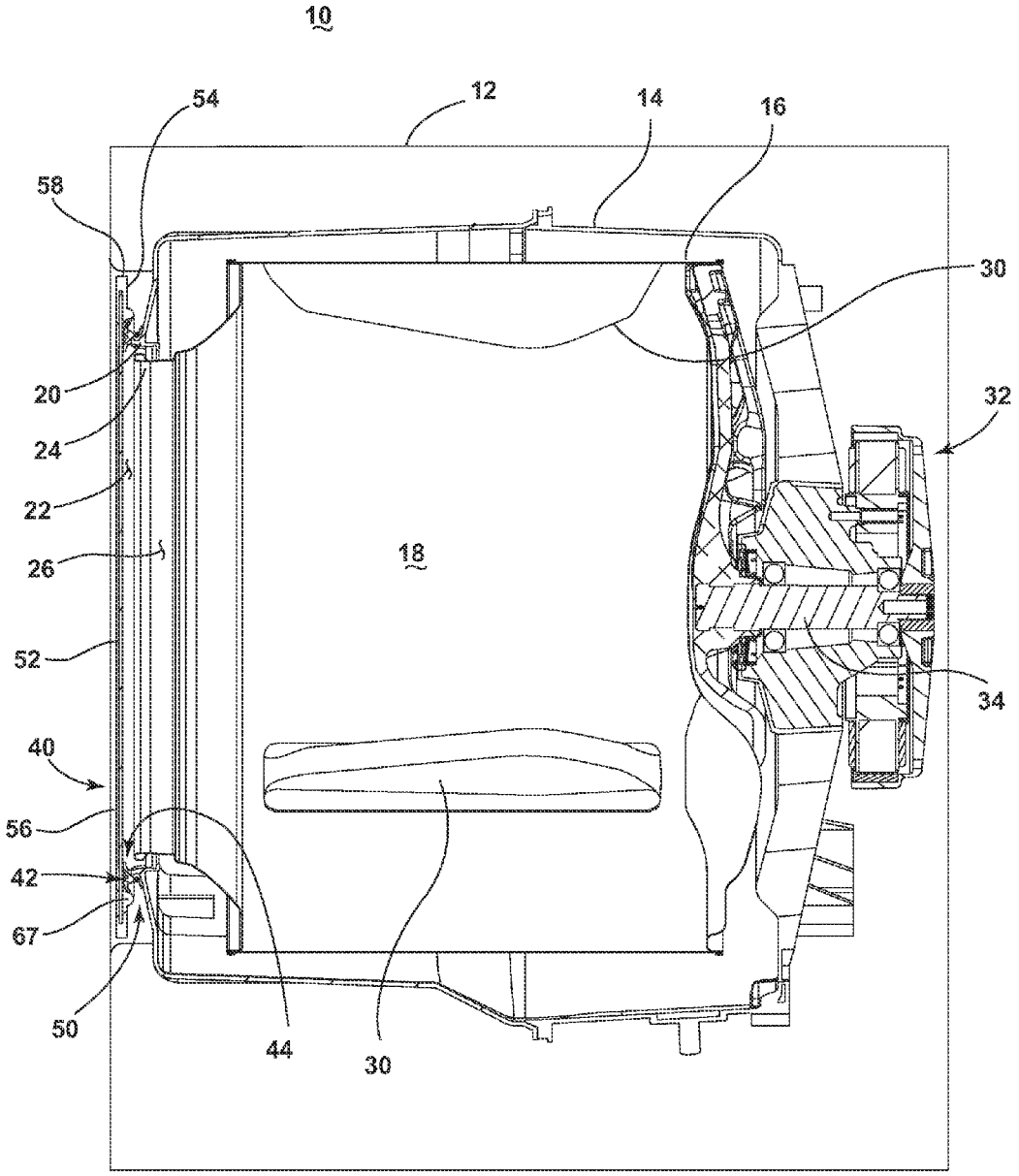
FIG. 1 is a schematic view of a laundry treating appliance in the form of a washing machine having a seal assembly according to a first embodiment of the invention.

FIG. 1 is a schematic view of a laundry treating appliance according to a first embodiment of the invention. The laundry treating appliance 10 may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; a clothes dryer and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 and a drum 16 provided within the tub 14, the drum 16 defining at least a portion of a laundry treating chamber 18. The tub 14 includes a tub rim 20 defining a tub opening 22 that provides access to an interior of the tub 14. The drum 16 includes a drum rim 24 defining a drum opening 26 that provides access to the laundry treating chamber 18. The drum 16 may include a plurality of perforations (not shown) such that liquid may flow between the tub 14 and the drum 16 through the perforations. A plurality of baffles 30 may be disposed on an inner surface of the drum 16 to lift the laundry load received in the laundry treating chamber 18 while the drum 16 rotates. It is also within the scope of the invention for the laundry holding system to comprise only a tub with the tub defining the laundry treating chamber.

The washing machine 10 also includes a drive system for rotating the drum 16 within the tub 14. The drive system may include a motor 32, which may be directly coupled with the drum 16 through a drive shaft 34 to rotate the drum 16 about a rotational axis during a cycle of operation. The motor 32 may be a brushless permanent magnet (BPM) motor having a stator and a rotor. Alternately, the motor 32 may be coupled to the drum 16 through a belt and a drive shaft to rotate the drum 16, as is known in the art. Other motors, such as an induction motor or a permanent split capacitor (PSC) motor, may also be used.

The washing machine 10 may further include additional components which are not germane to the embodiments of the invention and are not show for clarity. Non-limiting examples of such components include a suspension system for dynamically suspending the laundry holding system within the structural support system; a liquid supply system for supplying water to the washing machine 10 for use in treating laundry during a cycle of operation; a dispensing system for dispensing treating chemistry to the laundry treating chamber 18 for use in treating the laundry according to a cycle of operation; a recirculation and drain system for recirculating liquid within the laundry holding system and draining liquid from the washing machine 10; a heating system which may include one or more devices for heating laundry and/or liquid supplied to the tub 14, such as a steam generator and/or a sump heater; one or more sensors, such as a treating chamber temperature sensor, a moisture sensor, a weight sensor, a chemical sensor, a position sensor and a motor torque sensor, which may be used to determine a variety of system and laundry characteristics, such as laundry load inertia or mass; a control system for controlling the operation of the washing machine 10 to implement one or more cycles of operation; and a user interface that is operably coupled with the controller and including one or more knobs, dials, switches, displays, touch screens and the like for communicating with the user.

The laundry holding system may further include a door 40 which may be movably mounted to the cabinet 12 to selectively close both the tub opening 22 and the drum opening 26. The laundry holding system may also include a seal assembly 50 for sealing the tub opening 22 with the door 40 when the door 40 closes the tub opening 22. The seal assembly 50 includes a rigid seal element 42 carried by the door 40 and a flexible seal element 44 mounted to the tub rim 20 such that it circumscribes the tub opening 22.

Figure 2:
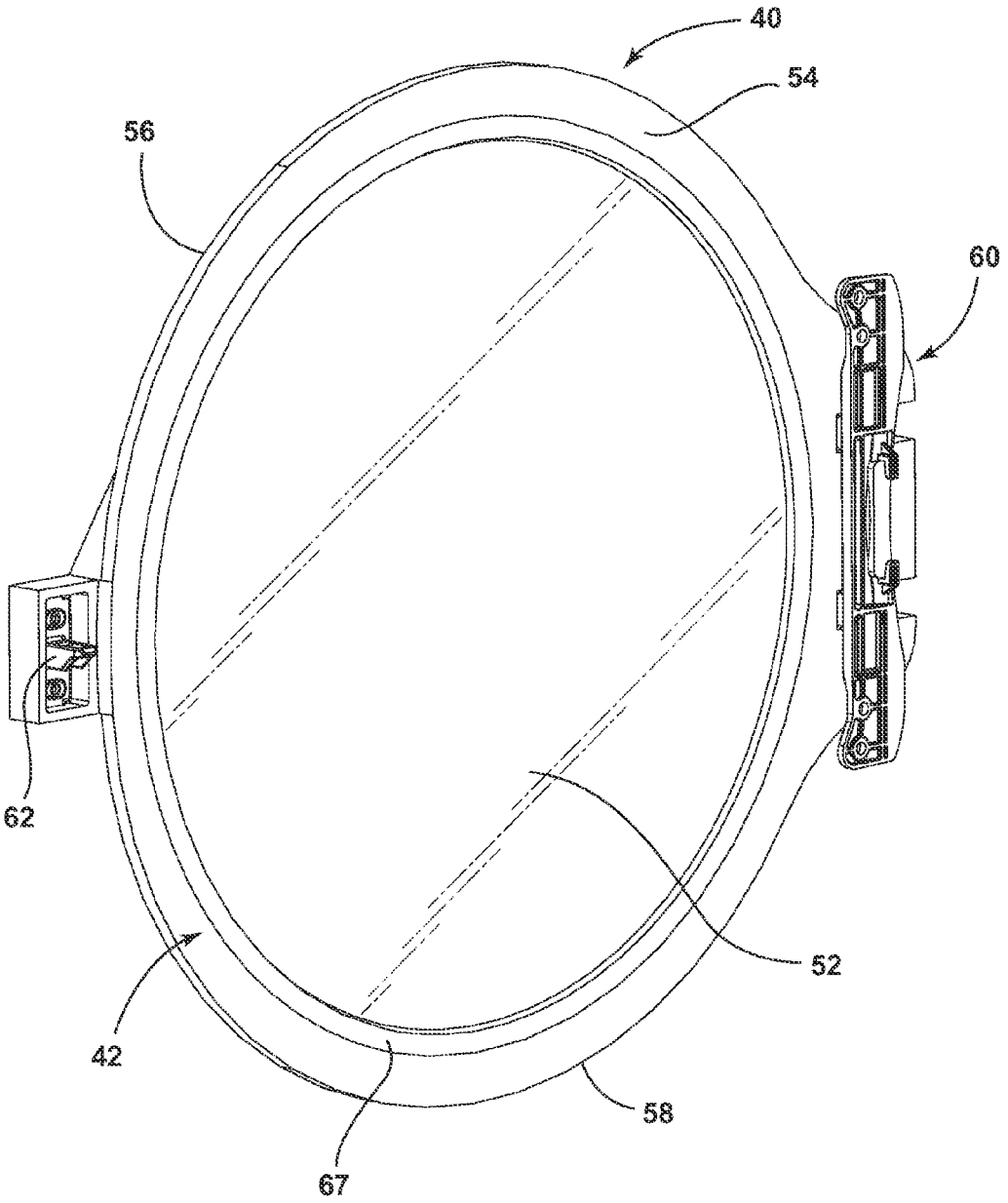
FIG. 2 is a perspective view of a door of the laundry treating appliance of FIG. 1 according to the first embodiment of the invention.

Referring now to FIG. 2, the door 40 includes a flat panel 52, and has a rear planar side 54 which is adjacent the tub opening 22 when the door 40 closes the tub opening 22 and a front side 56, which may or may not be planar. The flat panel 52 can be made from any suitable material, such as glass or plastic, and may be opaque or at least partially transparent such that at least some light may pass through the flat panel 52 to allow a user to view the laundry treating chamber 18 through the flat panel 52 when the door 40 is closed. The door 40 also includes a door frame 58 circumscribing a periphery of the flat panel 52. The door frame 58 may be mounted to the cabinet 12 using a hinge 60, and may also include a closure element 62 to secure the door 40 in the closed condition, as is known the in art. The door frame 58 may be made from any suitable material or combination of materials, non-limiting examples of which include plastic and metal. While the door 40 is illustrated as having a generally circular shape, it is within the scope of the invention for the door 40 to have any geometric shape depending on the design and desired aesthetics of the washing machine 10. For example, the door 40 may have a generally oval or rectangular shape. It is also within the scope of the invention for the door 40 to include additional components, such as a front frame and handle, for example, depending on the design and desired aesthetics of the door.

The rigid seal element 42 may be formed at least in part by at least one of the flat panel 52 and a raised element 67 carried by the door 40, such that at least a portion of the flexible seal element 44 abuts the rigid seal element 42 when the door 40 is closed. The raised element 67 may be carried by the door frame 58 and include a single raised element 67 circumscribing the door frame 58, as illustrated in FIG. 2. Alternatively, the rigid seal element 42 may comprise a plurality of discrete, spaced raised elements circumscribing the door frame 58. The raised element 67 may be a single, continuous raised feature or a series of raised features that at least partially circumscribes the door 40. It is also within the scope of the invention for the raised element 67 to be carried by the flat panel 52. The raised element 67 may be integrally formed with the door frame 58, as illustrated, or flat panel 52, or may be formed separately and secured to the door 40 using any suitable mechanical or non-mechanical fasteners, such as one or more screws, welds or adhesives, for example. The raised element 67 may be made from the same material as the door, such as plastic, or a different material, such as a natural or synthetic rubber. In one example, the raised element 67 may be part of a bezel or trim element that holds a peripheral edge of the flat panel 52. The bezel or trim element may be injection molded around the flat panel 52 to hold the flat panel 52 within the door frame 58.

Figure 3:
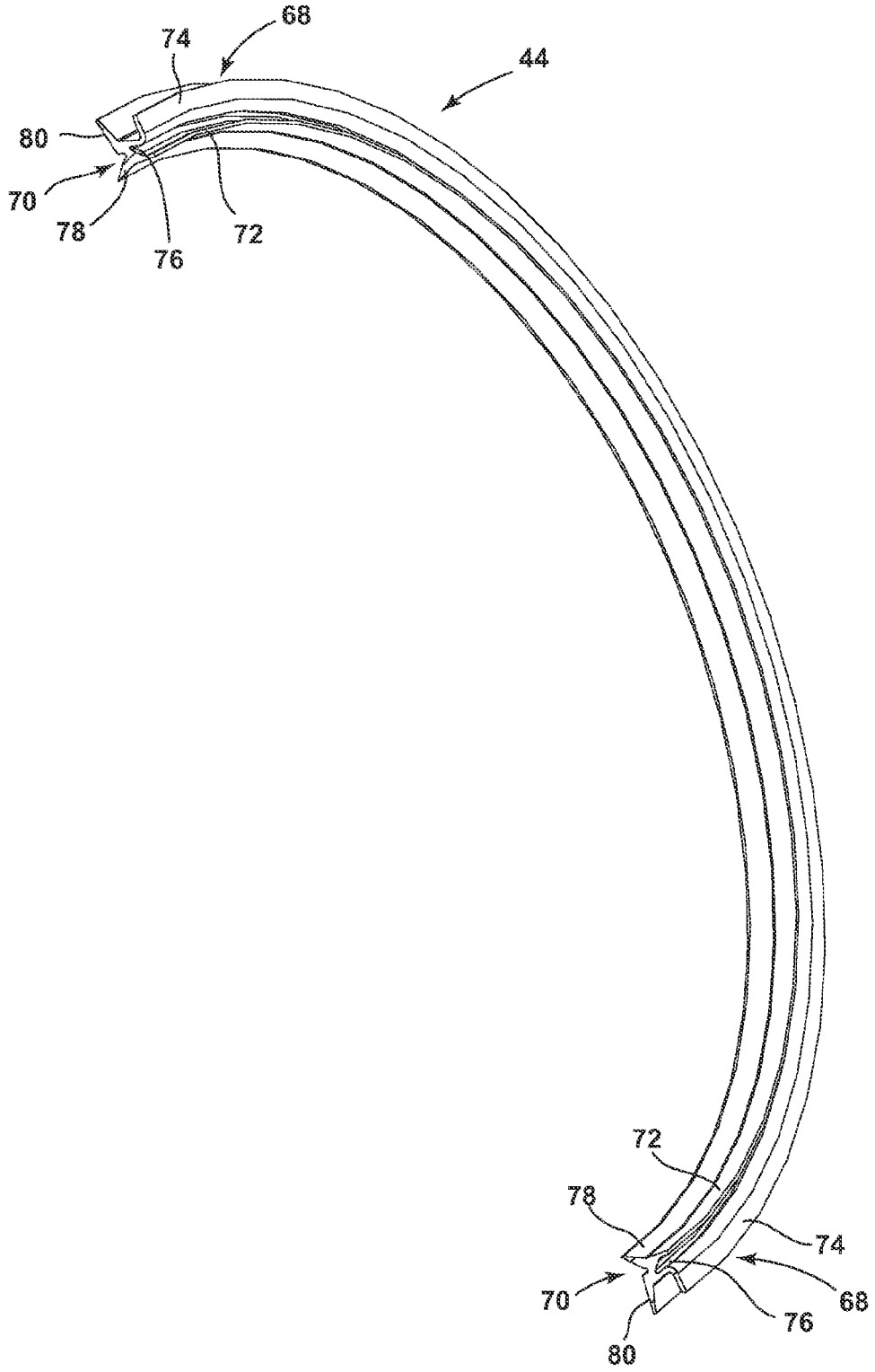
FIG. 3 is a perspective view of a portion of a flexible seal element of the laundry treating appliance of FIG. 1 according to the first embodiment of the invention.

Referring now to FIG. 3, the flexible seal element 44 is in the form of a ring for circumscribing the tub opening 22 when the flexible seal element 44 is mounted on the tub rim 20. The flexible seal element 44 may include a mounting portion 68 and a sealing portion 70. The mounting portion 68 may include a first leg 72 and a second leg 74, which together define a mounting channel 76. The sealing portion 70 may include a first seal 78 and a second seal 80.

The flexible seal element 44 may be made from any suitable flexible material such as a synthetic or natural rubber and/or mixture of materials. Non-limiting examples of suitable materials include ethylene propylene diene rubber (EPDM), nitrile butadiene rubber (NBR), silicone-based materials such as polydimethylsiloxane and fluorosilicone, a fluoroelastomer, a butyl rubber, a neoprene rubber and combinations thereof.

Figure 4:
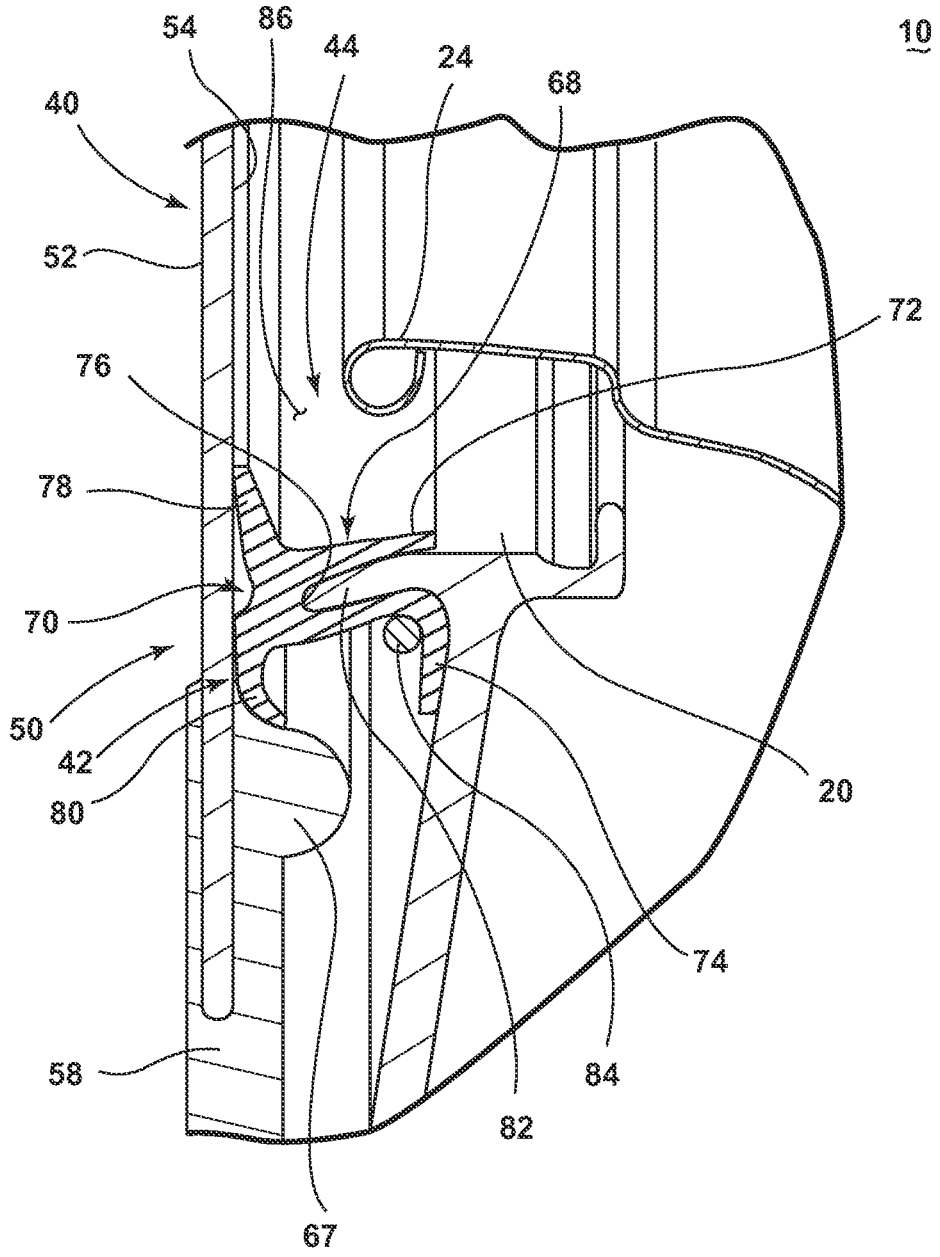
FIG. 4 is a cross-sectional view of a portion of the laundry treating appliance of FIG. 1 according to the first embodiment of the invention.

Referring now to FIG. 4, the tub rim 20 may include a flange 82 which is sized for receipt in the mounting channel 76 of the flexible seal element 44 for mounting the flexible seal element 44 to the tub 14. The flexible seal element 44 may be sized so as to be stretched and resiliently retained around the circumference of the tub rim 20. The flexible seal element 44 may be further secured to the tub rim 20 through a securing element 84, such as a wire, for example. Alternative or additional mechanical or non-mechanical fasteners, such as one or more welds or an adhesive, may also be used.

When the door 40 is closed, as illustrated in FIG. 4, the first seal 78 abuts the rear planar side 54 of the flat panel 52, forming a first, axial seal with the flat panel 52, and the second seal 80 abuts the raised element 67, forming a second, radial seal with the door 40. The tub 14 and drum 16 are configured such that the drum rim 24 extends over and is spaced above the tub rim 20, such that the drum rim 24 at least partially covers the flexible seal element 44. The drum rim 24 may be configured such that a gap 86 is provided between the drum rim 24 and the flat panel 52 when the door 40 is in the closed position, such that liquid may flow over the drum rim 24 and down over the tub rim 20 into the tub 14. The gap 86 may be wide enough to allow sufficient flow of liquid over the drum rim 24 and into the tub 14, but small enough to minimize the chance that laundry items will pass into the gap 86. For example, the gap 86 may be approximately 2-5 mm (0.08-0.2 inches).

Figure 5:
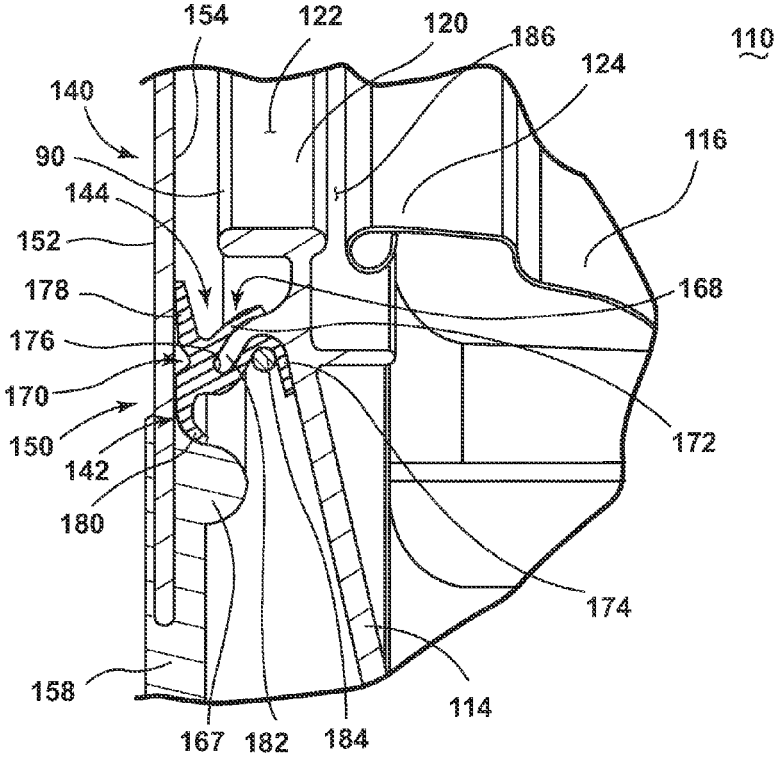
FIG. 5 is a cross-sectional view of a portion of a laundry treating appliance having a seal assembly according to a second embodiment of the invention.

FIG. 5 illustrates a second embodiment of the invention comprising a washing machine 110, similar to the washing machine 10 except for the tub 114 and drum 116. Therefore, elements of the washing machine 110 similar to those of the washing machine 10 will be numbered with the prefix 100.

The drum 116 is configured such that the drum rim 124 is axially spaced from the tub rim 120. A gap 186 may be provided between the tub rim 120 and the drum rim 124 to allow liquid to flow between the tub rim 120 and the drum rim 124, but is small enough so that laundry items do not pass between the tub rim 120 and the drum rim 124. An example of a suitable gap 186 is approximately 2-3 mm (0.08-0.1 inches). The tub rim 120 may include a flange 182, which is sized to be received within the mounting channel 176 of the flexible seal element 144 for mounting the flexible seal element 144 to the tub 114 in a manner similar to that described above for the flexible seal element 44 and tub 14 of the washing machine 10. The tub rim 120 may also include an upper flange 90 which extends above and projects over the flange 182 for at least partially covering the flexible seal element 144 when the flexible seal element 144 is mounted on the tub 114.

When the door 140 is in the closed position, the seal assembly 150 forms a seal between the tub 114 and the door 140 in the same manner as that described above for the washing machine 10. When the door 140 closes the tub opening 122, the first seal 178 abuts the flat panel 152, forming a first, axial seal, and the second seal 180 abuts the raised element 167, forming the second, radial seal.

Figure 6:
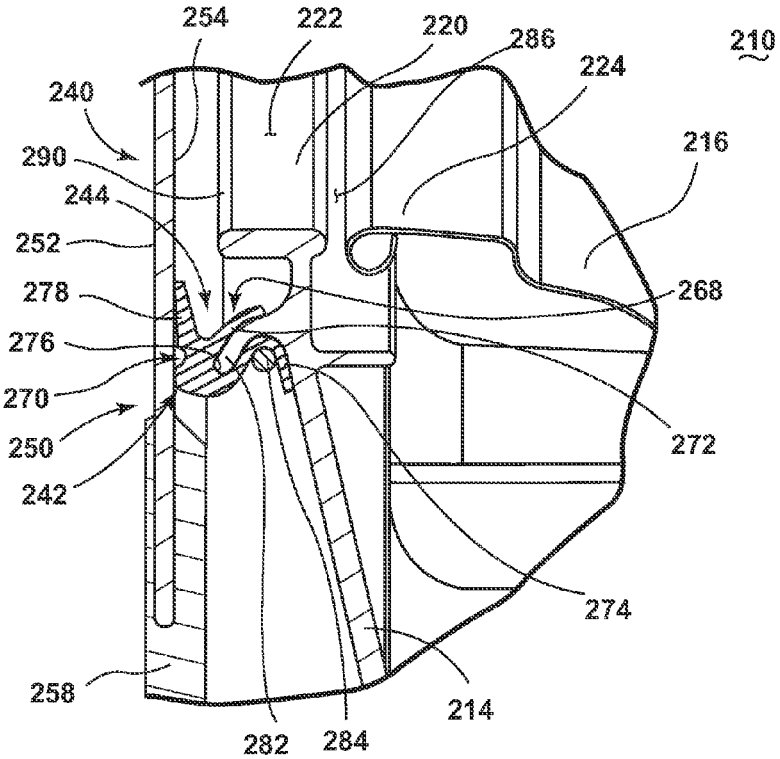
FIG. 6 is a cross-sectional view of a portion of a laundry treating appliance having a seal assembly according to a third embodiment of the invention.

FIG. 6 illustrates a third embodiment of the invention comprising a washing machine 210, similar to the washing machine 110 except for the seal assembly 250. Therefore, elements of the washing machine 210 similar to those of the washing machine 110 will be numbered with the prefix 200.

As illustrated in FIG. 6, the mounting portion 268 of the flexible seal element 244 is similar to the mounting portion 168 of the flexible seal element 144 and may be mounted to the tub rim 120 in a manner similar to that described above for the flexible seal element 144. The sealing portion 270 of the flexible seal element 244 includes a single seal 278. When the door 240 is in the closed position against the tub opening 222, the seal 278 abuts the flat panel 252 of the door 240, forming an axial seal. In this manner, the flat panel 252 of the door 240 forms the rigid seal element 242 of the seal assembly 250. It is also within the scope of the invention for the seal 278 to form an axial seal with the door frame 258. Because the flexible seal element 244 does not form the second, radial seal of the flexible seal element 144, the raised element 167 is not necessary on the door 240.

Figure 7:
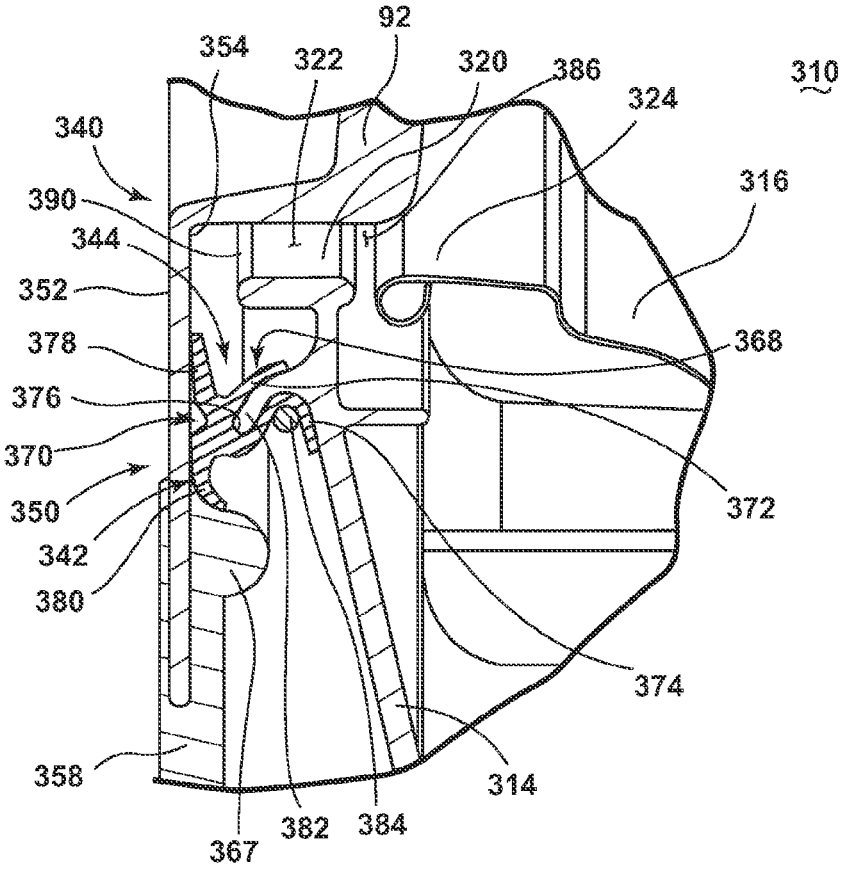
FIG. 7 is a cross-sectional view of a portion of a laundry treating appliance having a seal assembly according to a fourth embodiment of the invention.

FIG. 7 illustrates a fourth embodiment of the invention comprising a washing machine 310, similar to the washing machine 210 except for the door 340. Therefore, elements of the washing machine 310 similar to those of the washing machine 210 will be numbered with the prefix 300.

The door 340 of the washing machine 310 includes a bowl portion 92 circumscribed by a flat, planar portion 352 and a door frame 358. The parts of the door 340 are configured such that when the door 340 is in the closed position, the first seal 378 abuts the planar portion 352, forming the first, axial seal, and the second seal 380 abuts the raised element 367, forming the second, axial seal. The bowl portion 92 is configured such that when the door 340 closes the tub opening 322, the bowl portion 92 projects into the tub opening 322 over the tub rim 320 and at least partially covers the gap 386 between the tub rim 320 and the drum rim 324. The bowl portion 92 is spaced over and above the gap 386 such that fluid can still flow through the gap 386 between the tub rim 320 and the drum rim 324, but reduces the possibility that laundry items will pass into the gap 386.

While the embodiments of the invention have been described in the context of the tub carrying the flexible seal element and the door carrying the rigid seal element, it will be understood that the relative position of the flexible and rigid seal elements may be reversed without deviating from the scope of the invention.

The seal assembly described herein may be used with a washing machine having a traditional bowl-shaped door or a flat panel door. A flat panel door takes up less space within the treating chamber than a bowl-shaped door, increasing the capacity of the washing machine. The use of a flat panel door may also decrease the interaction of the door with the clothes. The bellows-type seals that are typically used on horizontal washing machines can be hard to clean, which can result in unpleasant odors, and also take up more room within the washing machine than the seal assembly described herein. The seal assembly may also decrease the transmission of vibrations from the tub and drum to the cabinet compared to a bellows-type seal, resulting in less noise and movement of the washing machine during operation. One possible explanation for the increase in vibrations in washing machine having a bellows-type seal is that the bellows may provide a direct path for vibrations to travel from the tub and drum to the cabinet.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance configured to execute a cycle of operation for treating laundry, comprising:
- a tub at least partially defining an interior and having a rim at one end defining a tub opening providing access to the tub interior;
- a drum at least partially defining a treating chamber and having a drum opening providing access to the treating chamber;
- a door selectively moveable to close the tub opening comprising:
  - a flat panel having a generally flat rear planar side facing the tub, wherein the flat panel spans the tub opening and lies exteriorly of the tub opening when the door closes the tub opening;
  - a frame encasing a periphery of the flat panel; and
  - a raised element formed on the rear planar side of the flat panel or the frame; and
- a seal assembly provided on the tub to seal the rear planar side of the flat panel to the tub and wherein at least a portion of the seal assembly abuts the raised element when the door closes the tub opening.

2. The laundry treating appliance of claim 1 wherein the seal assembly comprises a rigid seal element formed on one of the door or the tub, a flexible seal element projecting from the other of the door and the tub, with the rigid seal element and the flexible seal element abutting each other when the door closes the tub opening.

3. The laundry treating appliance of claim 2 wherein the flexible seal element projects from the tub.

4. The laundry treating appliance of claim 3 wherein at least a portion of the rigid seal element comprises a portion of the frame.

5. The laundry treating appliance of claim 4 wherein the rigid seal element is formed in part by the rear planar side and in part by the raised element and wherein the flexible seal element comprises a first flexible seal that abuts the rear planar side when the door closes the tub and a second flexible seal that abuts the raised element when the door closes the tub opening.

6. The laundry treating appliance of claim 5 wherein the flexible seal element projects from a portion of the tub defining the tub opening.

7. The laundry treating appliance of claim 6 wherein a portion of the drum overlies at least a portion of the flexible seal element.

8. The laundry treating appliance of claim 7 wherein the portion of the drum is the drum opening.

9. The laundry treating appliance of claim 6 wherein the flexible seal element is mounted to the rim of the tub.

10. The laundry treating appliance of claim 2 wherein the rigid seal element circumscribes at least a portion of the rear planar side and the flexible seal element circumscribes the tub opening, the flexible seal element forming a first seal with the rear planar side.

11. The laundry treating appliance of claim 10 wherein the rigid seal element further comprises the raised element and the flexible seal element forms a second seal with the raised element.

12. The laundry treating appliance of claim 1 wherein the drum comprises a drum rim defining the drum opening, and a gap between the drum rim and the tub is insufficient for laundry to pass between.

13. The laundry treating appliance of claim 12 wherein the drum rim is located axially behind the tub rim.

14. The laundry treating appliance of claim 1 wherein the flat panel comprises an at least partially transparent portion.

15. A laundry treating appliance configured to execute a cycle of operation for treating laundry, comprising:

a tub at least partially defining an interior and having a rim at one end defining a tub opening providing access to the tub interior;

a drum at least partially defining a treating chamber and having a drum opening providing access to the treating chamber;

a door selectively moveable to close the tub opening comprising:

a flat panel having a generally flat rear planar side facing the tub, wherein the flat panel spans the tub opening and lies exteriorly of the tub opening when the door closes the tub opening;

a frame mounted to the flat panel and surrounding a periphery thereof; and a raised element formed on the rear planar side of the flat panel or the frame; and a seal assembly provided on the tub and configured to seal the rear planar side of the flat panel to the tub, wherein the seal assembly comprises a flexible seal that abuts the raised element when the door closes the tub opening.

16. A laundry treating appliance configured to execute a cycle of operation for treating laundry, comprising:

a tub at least partially defining an interior and having a rim at one end defining a tub opening providing access to the tub interior;

a drum at least partially defining a treating chamber and having a drum opening providing access to the treating chamber;

a door selectively moveable to close the tub opening comprising:

a flat panel having a generally flat rear planar side facing the tub, wherein the flat panel spans the tub opening and lies exteriorly of the tub opening when the door closes the tub opening; and a frame mounted to the flat panel and having a raised element formed thereon; and a seal assembly provided on the tub and comprising a first seal that abuts the rear planar side of the flat panel when the door closes the tub opening to form a first axial seal and a second seal that abuts the raised element when the door closes the tub opening to form a second axial seal.

* * * * *